US006882821B2

(12) United States Patent
Jeong et al.

(10) Patent No.: US 6,882,821 B2
(45) Date of Patent: Apr. 19, 2005

(54) APPARATUS FOR DISCHARGING WASTE TONER

(75) Inventors: Heung-sup Jeong, Suwon (KR); Moon-bae Park, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/642,263

(22) Filed: Aug. 18, 2003

(65) Prior Publication Data

US 2004/0052559 A1 Mar. 18, 2004

(30) Foreign Application Priority Data

Sep. 13, 2002 (KR) ..... 10-2002-0055814

(51) Int. Cl.[7] ..... G03G 21/00

(52) U.S. Cl. ..... 399/358; 222/DIG. 1; 399/35; 399/120

(58) Field of Search ..... 399/35, 119, 120, 399/167, 358, 359, 360; 222/DIG. 1

(56) References Cited

FOREIGN PATENT DOCUMENTS

JP 06-242710 * 9/1994

* cited by examiner

*Primary Examiner*—Hoang Ngo
(74) *Attorney, Agent, or Firm*—Staas & Halsey LLP

(57) ABSTRACT

An apparatus for discharging waste toner, including a housing temporarily storing waste toner separated from a surface of a photosensitive medium; a waste toner discharge port formed at a bottom of the housing; a shutter rotatably disposed at a side of the housing to open and cover the waste toner discharge port; a pinion gear to rotate the shutter; and a fixed gear, disposed on a frame to which the housing is mounted, engaging the pinion gear, the pinion gear rotating along the fixed gear when the housing is mounted to the frame, to rotate the shutter away from the waste toner discharge port. The shutter includes a latch to hold the shutter in place when the shutter covers the waste toner discharge port.

16 Claims, 5 Drawing Sheets

APPARATUS FOR DISCHARGING WASTE TONER

CROSS-REFERENCE TO RELATED APPLICATIONS

This application claims the benefit of Korean Patent Application No. 2002-55814, filed Sep. 13, 2002, in the Korean Intellectual Property Office, the disclosure of which is incorporated herein by reference.

BACKGROUND OF THE INVENTION

1. Field of the Invention

The present invention relates to an image forming unit of an electrophotographic image forming apparatus and, more particularly, to an apparatus for discharging waste toner produced in an image forming unit.

2. Description of the Related Art

In general, an electrophotographic image forming apparatus includes an image forming unit to form a desired image by receiving a signal from, for example, a computer, a paper supplying unit to supply paper on which the desired image will be transferred, and a fixing unit to fix the transferred image on the paper.

An example of an image forming unit 10 for producing an image on paper is shown in FIG. 1.

A laser beam scanned from a laser scan unit 11 creates an electrostatic latent image on a photosensitive medium 12. The electrostatic latent image formed on the photosensitive medium 12 is developed into a visible image by toner 15 supplied by a developing roller 14. The developed visible image is transferred to paper 1 supplied from a paper supply unit (not shown) by a transfer roller 16. After the transfer of the visible image, the remaining toner (hereinafter referred to as "waste toner") is separated from the photosensitive medium 12 by a waste toner cleaner 18. The separated toner (i.e., waste toner 42) is discharged out of a housing 19 by a waste toner discharge apparatus 20.

Referring to FIG. 2, the waste toner discharge apparatus 20 includes an auger 30 disposed under and parallel to the waste toner cleaner 18, an auger supporting member 22 having a waste toner discharge port 24 supporting the rotational movement of the auger 30, a shutter 26 rotatably disposed at a side of the auger supporting member 22 opposite the auger 30 for opening and closing the waste toner discharge port 24, a lever 28 disposed at a side of the shutter 26 opposite the auger supporting member 22, and a projection 32 disposed at a position interfering with the lever 28 when the image forming unit 10 is mounted on a frame 50 (FIG. 1).

When the image forming unit 10 is mounted on the frame 50, the shutter 26 rotates around the circumference of the auger supporting member 22 via the projection 32 to expose the waste toner discharge port 24 thereby opening the waste toner discharge apparatus 20.

Thus, the waste toner 42 separated by the waste toner cleaner 18 is moved to the auger supporting member 22 by the auger 30 and discharged out of the housing 19 through the waste toner discharge port 24. A waste toner container 40 is disposed under the waste toner discharge port 24 and the discharged waste toner 42 is collected in the waste toner container 40.

When the photosensitive medium 12 is changed or the waste toner container 40 is emptied, the image forming unit 10 is disassembled from the frame. If the image forming unit 10 is raised, the lever 28 of the waste toner discharge apparatus 20 is no longer held in place by the projection 32, and the shutter 26 rotates in reverse by a torsion spring (not shown) between the shutter 26 and the auger supporting member 22 to cover the waste toner discharge port 24 (FIG. 3). Therefore, the waste toner 42 remaining in the housing 19 of the image forming unit 10 does not flow out and the image forming unit 10 can be freely disassembled and treated.

However, in the waste toner discharge apparatus 20 with a shutter 26 that returns via a torsion spring, as described above, the shutter 26 may fail to completely cover the waste toner discharge port 24 when the torsion spring is transformed. Also, when the waste toner 42 collects around the waste toner discharge port 24, frictional resistance between the auger supporting member 22 and the shutter 26 increases and, hence, the action of the torsion spring may not cause the shutter 26 to completely cover the waste toner discharge port. When the shutter 26 fails to completely cover the waste toner discharge port 24, the waste toner 42 leaks out upon disassembly/assembly of the image forming unit 10, thereby causing contamination of the image forming apparatus.

Further, even when the image forming unit 10 is disassembled, while the shutter 26 of the waste toner discharge apparatus 20 is completely closed, the projecting lever 28 may be inadvertently pushed by a user. If the lever 28 is pushed, the shutter 26 will move and, consequently, the waste toner discharge port 24 is opened and the waste toner 42 remaining in the housing 19 flows out, causing contamination of the surroundings.

SUMMARY OF THE INVENTION

It is an aspect of the present invention to provide an apparatus for discharging waste toner, in which the waste toner does not leak out by completely closing a waste toner discharge port when an image forming unit is removed from an image forming apparatus.

It is another aspect of the present invention to provide an apparatus for discharging waste toner, in which a waste toner discharge port is not inadvertently opened by a user, even when the apparatus is exposed upon disassembly of an image forming unit.

To achieve the above and/or other aspects of the present invention, there is provided an apparatus for discharging waste toner, including a housing temporarily storing waste toner separated from a surface of a photosensitive medium; a waste toner discharge port formed at a bottom of the housing; a shutter rotatably disposed at a side of the housing to open and cover the waste toner discharge port; a pinion gear to rotate the shutter; and a fixed gear, disposed on a frame to which the housing is mounted, engaging the pinion gear, the pinion gear rotating along the fixed gear when the housing is mounted to the frame, to rotate the shutter away from the waste toner discharge port.

The shutter further includes a latch to hold the shutter in place when the shutter covers the waste toner discharge port. The waste toner discharge port has a projection to engage the latch.

Also, a rack gear is used as the fixed gear.

The pinion gear is formed on an outer circumference of the shutter, or on a side of the shutter.

A waste toner container formed under the waste toner discharge port to receive the waste toner discharged from the waste toner discharge port.

To achieve the above and/or other aspects of the present invention, there is provided an apparatus for discharging waste toner, including a housing storing waste toner separated from a photosensitive medium; an auger disposed at a lower part inside the housing to gather the waste toner in a predetermined area; an auger supporting member disposed at a side of the housing to rotatably support the auger; a waste toner discharge port formed at a bottom of the auger supporting member, through which the waste toner gathered by the auger is discharged; a shutter rotatably disposed at a side of the auger supporting member to open and close the waste toner discharge port; a pinion gear to rotate the shutter; and a fixed gear, disposed on a frame to which the housing is mounted, engaging the pinion gear, the pinion gear rotating along the fixed gear when the housing is mounted to the frame, to rotate the shutter to open the waste toner discharge port.

As described above, the shutter of the apparatus for discharging waste toner according to the present invention operates by rotation of a pinion gear to completely cover the waste toner discharge port when an image forming unit is disassembled.

To achieve the above and/or other aspects according to the present invention, there is provided an apparatus for discharging waste toner, including a housing detachably mounted to a frame and temporarily storing waste toner; an auger; an auger supporting member rotatably supporting the auger; a waste toner discharge port in the auger supporting member, the auger rotating to gather waste toner and discharge the waste toner from the waste toner discharge port; a shutter to open and cover the waste toner discharge part; a pinion gear formed on a circumference of the shutter; a fixed gear attached to the frame; a latch on a side of the shutter; and a projection on the auger supporting member adjacent to the waste toner discharge port, wherein when the housing is disassembled from the frame, the pinion gear rotates along the fixed gear in a first direction, which rotates the shutter to cover the waste toner discharge port, the latch engaging the projection to hold the shutter in place over the waste toner discharge port, and wherein when the housing is mounted to the frame, the pinion gear rotates along the fixed gear in a direction opposite the first direction, which rotates the shutter and releases the latch from the projection to open the waste toner discharge port.

To achieve the above and/or other aspects according to the present invention, there is provided a method of disassembling and assembling an apparatus for discharging waste toner, the apparatus comprising a housing detachably mounted to a frame, an auger supporting member rotatably supporting an auger that rotates to gather waster toner for discharge through a waster toner discharge port, a shutter to open and close the waste toner discharge port, a pinion gear formed on a circumference of the shutter, a fixed gear attached to the frame, a latch on a side of the shutter, and a projection on the auger supporting member adjacent to the waste toner discharge port, the method including disassembling the housing from the frame by lifting the housing, said lifting the housing comprising rotating the pinion gear along the fixed gear in a first direction and rotating the shutter to cover the waste toner discharge port, engaging the latch with the projection to hold the shutter in place over the waster toner discharge port, and releasing the pinion gear from the fixed gear; and assembling the housing to the frame by engaging the pinion gear with the fixed gear and lowering the housing, said lowering the housing comprising rotating the pinion gear along the fixed gear in a direction opposite the first direction and rotating the shutter to release the latch from the projection and open the waste toner discharge port.

These, together with other aspects and/or advantages that will be subsequently apparent, reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

These and/or other aspects and advantages of the present invention will become apparent and more readily appreciated from the following description of the preferred embodiments, taken in conjunction with the accompanying drawings, of which.

DESCRIPTION OF THE PREFERRED EMBODIMENT

Figure 1:
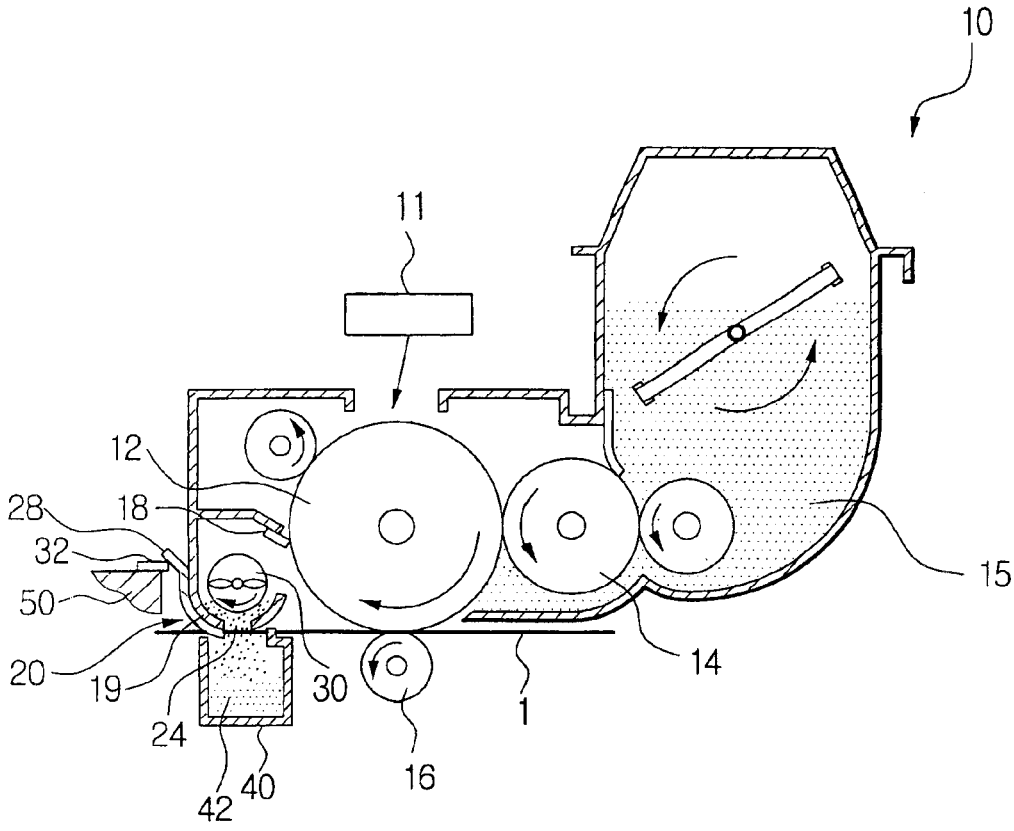
FIG. 1 (PRIOR ART)
FIG. 1 is a schematic view of a conventional image forming unit used in an electrophotographic image forming apparatus.
Figure 2:
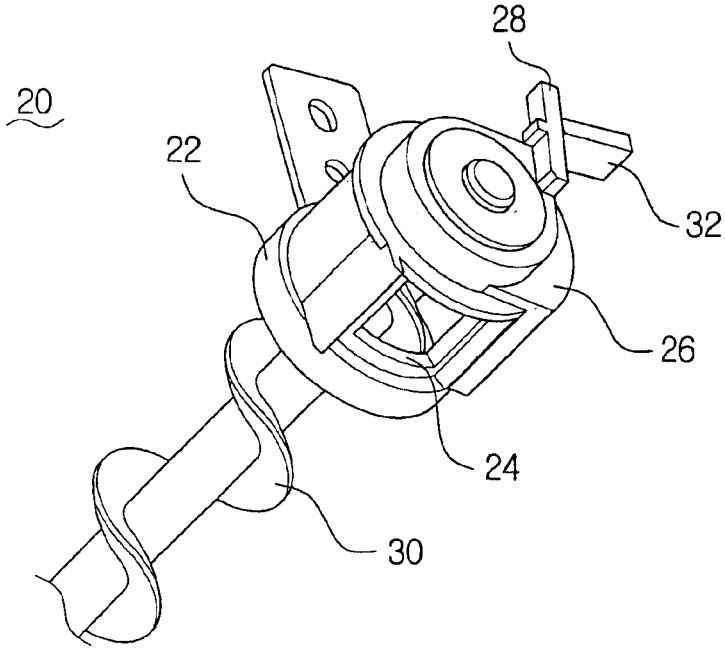
FIG.2 (PRIOR ART)
FIG. 2 is a perspective view of a conventional waste toner discharge apparatus in an open state used in the image forming unit of FIG. 1.
Figure 3:
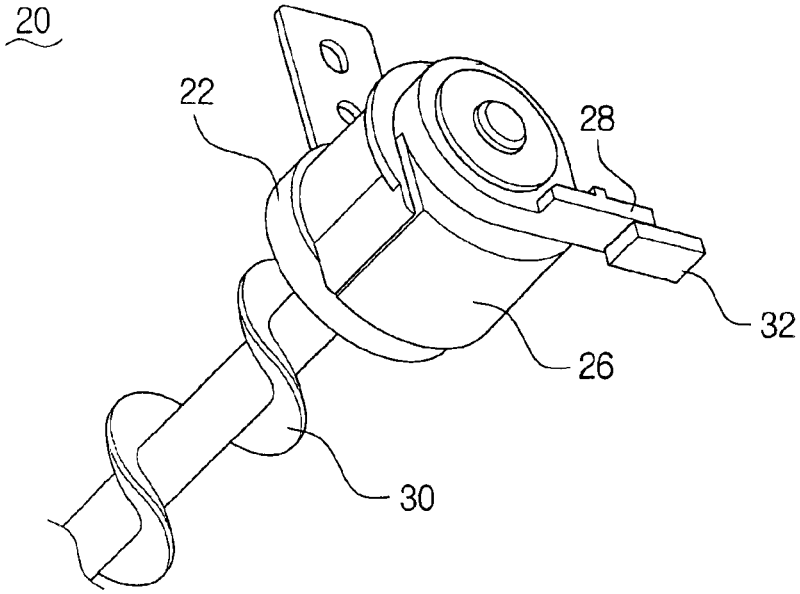
FIG.3 (PRIOR ART)
FIG. 3 is a perspective view of the conventional waste toner discharge apparatus of FIG. 2 in a closed state.

Hereinafter, an embodiment of the present invention will be described in detail with reference to the attached drawings, wherein the like reference numerals refer to the like elements throughout. The present invention may, however, be embodied in many different forms and should not be construed as being limited to the embodiment set forth herein; rather, this embodiment is provided so that the present disclosure will be thorough and complete, and will fully convey the concept of the invention to those skilled in the art.

Referring to FIGS. 4 through 8, the waste toner discharge apparatus 100 according to the present invention includes a housing 102, an auger 130, an auger supporting member 110, a shutter 120, and a fixed gear 140.

The housing 102, which is a part of an image forming unit 10 (FIG. 1) temporarily stores waste toner 42 separated from the photosensitive medium 12 (FIG. 1) by the waste toner cleaner 18 (FIG. 1) so that the waste toner 42 does not leak out.

The auger 130 has a screw-shape and is parallel to the waste toner cleaner 18 in the lower part of the housing. The auger 130 rotates to gather the waste toner 42 and discharge the waste toner 42 from the waste toner discharge port 24.

The auger supporting member 110 rotatably supports an end of the auger 130 and is disposed where the waste toner 42 is gathered by the auger 130. Provided at the bottom of the auger support member 110 is a waste toner discharge port 112 through which the waste toner 42 is discharged from the housing 102. The waste discharge port 112 has a projection 114 at one side thereof that engages a latch 128 of the shutter 120 (described below). Also, a rotation axis member 116 (FIG. 8) supporting the shutter 120 projects from a side of the auger supporting member 110.

The shutter 120 is sized to cover the waste toner discharge port 112. The shutter 120 rotates in conjunction with a pinion gear 124, which engages a fixed gear 150 described below. The pinion gear 124 may be integrally formed with the shutter 120, or may be fabricated as a separate part that is assembled to a side of the shutter 120. In the embodiment shown in FIGS. 4 through 8, the pinion gear 124 is formed as a partial gear on the circumference of the shutter 120, with an axis hole 126 formed therethrough that receives the rotation axis member 116 of the auger supporting member 110. The pinion gear 124 is sized such that the shutter 120 is completely opened and closed by rotation of the pinion gear 124 when the housing 102 is assembled to, or disassembled from, the frame 150. Also, a latch 128 provided on the shutter 120 engages the projection 114 disposed at a side of the waste toner discharge port 112 when the shutter 120 closes the waste toner port 112 by rotating around the rotation axis member 116. When the housing 102 is disassembled from the frame 150, the pinion gear 124 rotates along the fixed gear 140, causing the shutter 120 to rotate and the latch 128 to engage the projection 114. When the housing 102 is mounted on frame 150, the pinion gear 124 rotates along the fixed gear 140 in the opposite direction, causing the latch 128 on the shutter 120 to rotate away from the projection 114. However, when the image forming unit 10 is disassembled and removed from the electrophotographic image forming apparatus, the latch 128 does not release if a user inadvertently touches the pinion gear 124.

The fixed gear 140 guides the pinion gear 124 and is disposed on the frame 150 to which the housing 102 is assembled. The fixed gear 140 has a dimension sufficient to allow the pinion gear 124 to rotate so that the shutter 120 does not cover the waste toner discharge port 112 when the housing 102 is assembled, and the shutter 120 completely covers the waste toner discharge port 112 when the housing 102 is disassembled. When the shutter 120 includes the latch 128, the pinion gear 124 rotates until the latch 128 engages the projection 114. A rack gear, for example, is used as the fixed gear 140 for easy assembly and disassembly of the housing 102.

Under the auger supporting member 110, a waste toner container 40 (FIG. 1) is disposed to receive the waste toner 42 dropping from the waste toner discharge port 112. That is, the waste toner 42, which has been transferred by the auger 130 and discharged through the waste toner discharge port 112, is collected in the waste toner container 40.

Operation of the apparatus for discharging the waste toner 42 according to the present invention is explained below with reference to FIGS. 4 through 7.

Figure 4:
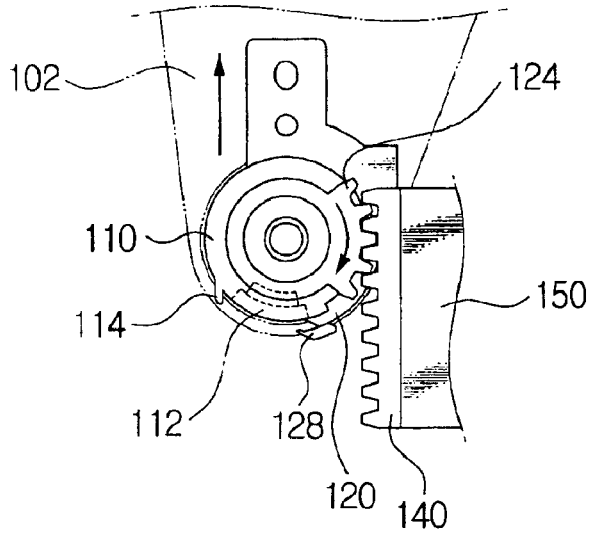
FIG. 4 is a conceptual diagram showing a housing of the waste toner discharge apparatus according to the present invention mounted on a frame.
Figure 5:
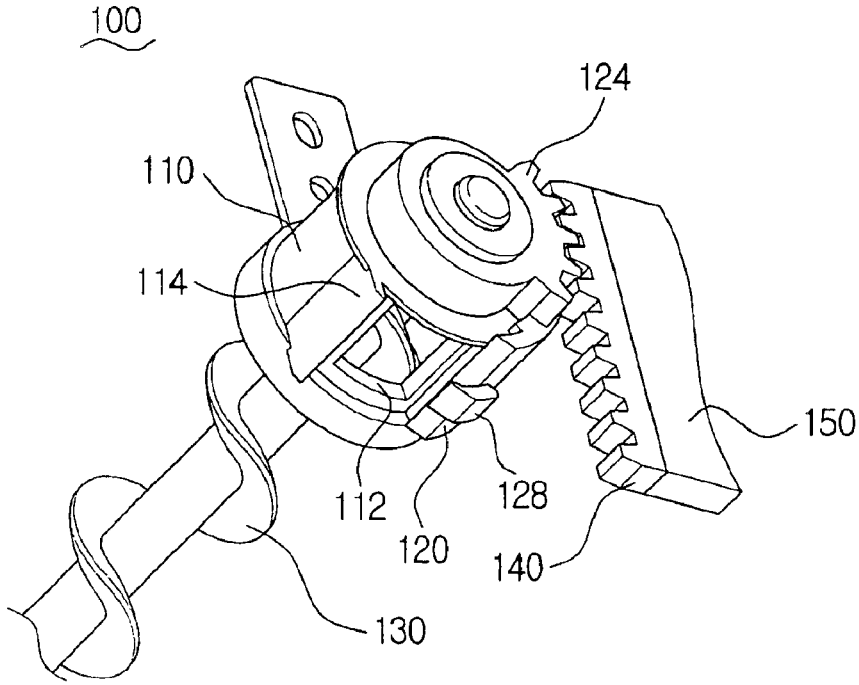
FIG. 5 is a perspective view of an open waste toner discharge port in the waste toner discharge apparatus shown in FIG. 4.

When the housing 102 is mounted on the frame 150, as shown in FIGS. 4 and 5, the shutter 120 does not cover the waste toner discharge port 112. Therefore, the waste toner 42 transferred by the auger 130 can be discharged out of the housing 102 through the waste toner discharge port 112.

Figure 7:
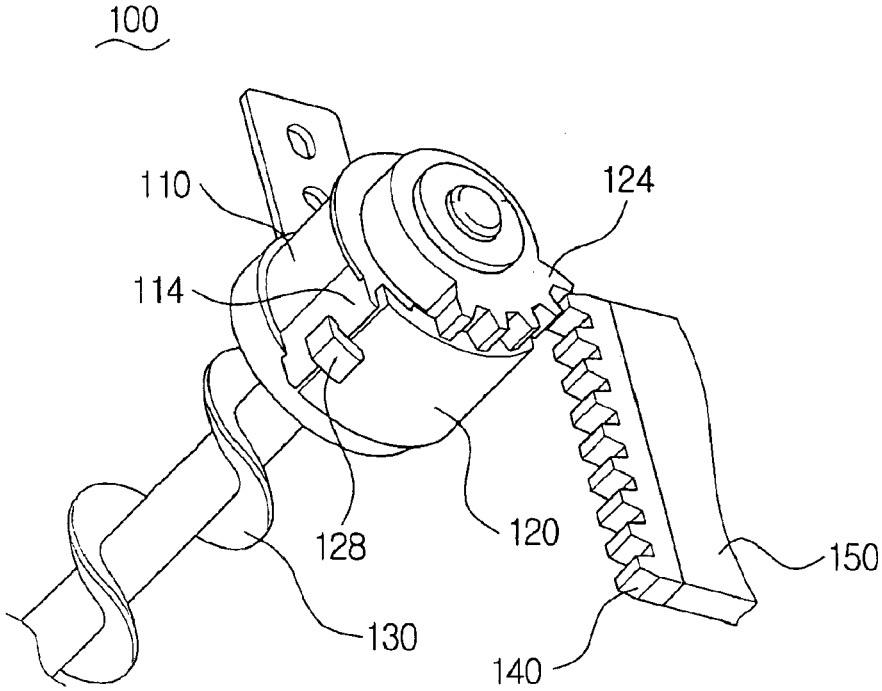
FIG. 7 is a perspective view of the waste toner discharge port in the waste toner discharge apparatus of FIG. 6 in the closed state.
Figure 8:
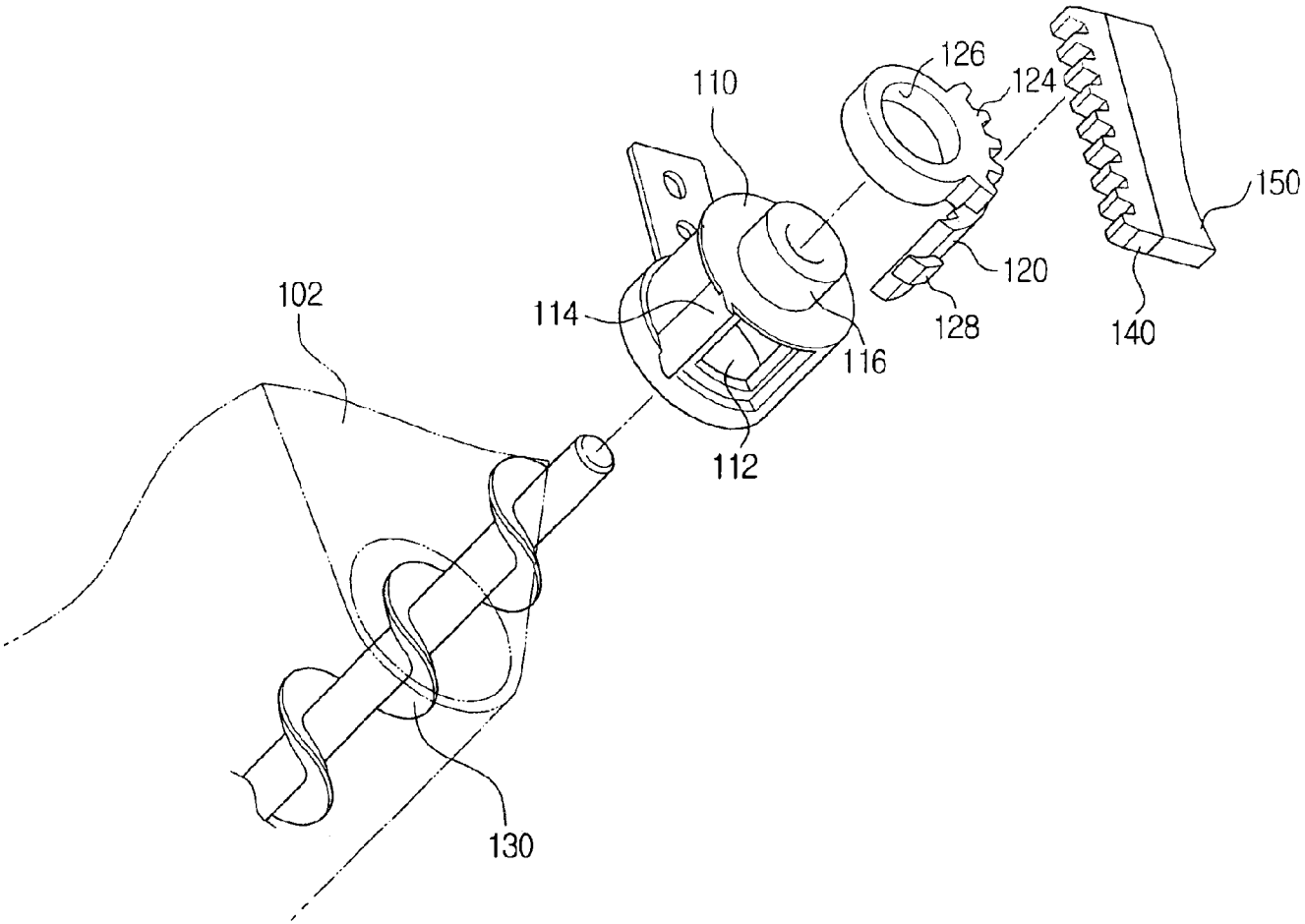
FIG. 8 is an exploded perspective view of the components of the waste toner discharge apparatus shown in FIG. 4.

To disassemble the housing 102 from the frame 150, the housing 102 is lifted. As the housing 102 moves upward, the pinion gear 124 engages the fixed gear 140 and rotates clockwise. The shutter 120 that is integrally formed with the pinion gear 124 begins to cover the waste toner discharge port 112. The shutter 120 completely covers the waste toner discharge port 112 when the pinion gear 124 is released from the fixed gear 140 (FIG. 7). When the latch 128 is provided on the shutter 120, the latch 128 engages the projection 114 at the side of the waste toner discharge port 112.

Because the shutter 120 closes by the rotation of the pinion gear 124, the waste toner discharge port 112 remains closed when the housing 102 is disassembled from the frame 150. Also, the shutter 120 is not easily opened by careless or inadvertent touches because the latch 128 engages the projection 114 when the housing 102 is disassembled to hold the shutter 120 in place.

Figure 6:
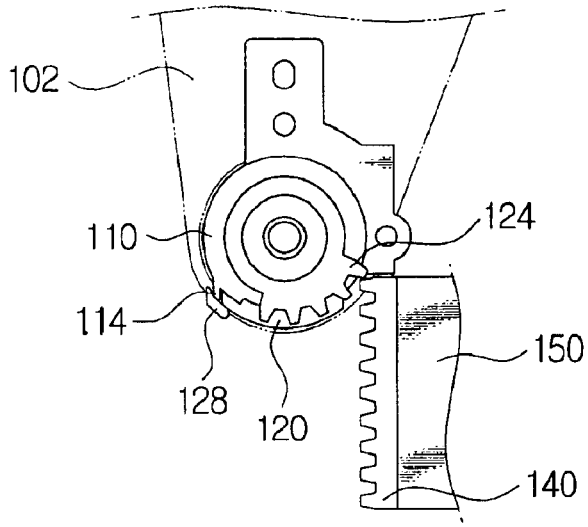
FIG. 6 is a conceptual diagram showing the housing of the waste toner discharge apparatus of FIG. 4 disassembled from the frame.

The shutter 120 always covers the waste toner discharge port 112 when the housing 102 is disassembled. When the housing 102 is initially mounted onto the frame 150, the pinion gear 124 of the shutter 120 begins to contact the fixed gear 140. Referring to FIG. 6, as the housing 102 continues to be mounted to the frame 150, the pinion gear 124 rotates counterclockwise while moving along the fixed gear 140, and the shutter 120 that is integrally formed with the pinion gear 124 begins to open the waste toner discharge port 112. The force applied to insert the housing 102 onto the frame 150 releases the latch 128 from the projection 114. When the housing 102 is completely mounted on the frame 150, the shutter 120 is in a position such that the waste toner discharge port 112 is fully opened, as shown in FIG. 5.

In the apparatus for discharging waste toner according the present invention, because the shutter 120 has a latch 128, the shutter 120 is not easily opened due to a user's careless or inadvertent touch. Therefore, according to the present invention, when an image forming unit 10 is disassembled, problems such as contamination of the image forming unit 10 or the surroundings due to leakage of the waste toner do not occur.

Although an embodiment of the present invention has been shown and described it will be appreciated by those skilled in the art that changes may be made in this embodiment without departing from the principles and spirit of the invention, the scope of which is defined in the claims and their equivalents.

What is claimed is:

1. An apparatus for discharging waste toner, comprising:

a housing temporarily storing waste toner separated from a surface of a photosensitive medium;

a waste toner discharge port formed at a bottom of the housing;

a shutter rotatably disposed at a side of the housing to open and cover the waste toner discharge port;

a pinion gear to rotate the shutter; and a fixed gear, disposed on a frame to which the housing is mounted, engaging the pinion gear, the pinion gear rotating along the fixed gear when the housing is mounted to the frame, to rotate the shutter away from the waste toner discharge port.

2. The apparatus according to claim 1, wherein the shutter comprises a latch to hold the shutter in place when the shutter covers the waste toner discharge port.

3. The apparatus according to claim 2, wherein the waste toner discharge port has a projection to engage the latch.

4. The apparatus according to claim 1, wherein the fixed gear is a rack gear.

5. The apparatus according to claim 1, wherein the pinion gear is integrally formed with the shutter on an outer circumference of the shutter.

6. The apparatus according to claim 1, wherein the pinion gear engages the shutter on a side of the shutter.

7. The apparatus according to claim 1, further comprising a waste toner container formed under the waste toner discharge port to receive the waste toner discharged from the waste toner discharge port.

8. An apparatus for discharging waste toner comprising:

a housing storing waste toner separated from a photosensitive medium;

an auger disposed at a lower part inside the housing to gather the waste toner in a predetermined area;

an auger supporting member disposed at a side of the housing to rotatably support the auger;

a waste toner discharge port formed at a bottom of the auger supporting member, through which the waste toner gathered by the auger is discharged;

a shutter rotatably disposed at a side of the auger supporting member to open and close the waste toner discharge port;

a pinion gear to rotate the shutter; and a fixed gear, disposed on a frame to which the housing is mounted, engaging the pinion gear, the pinion gear rotating along the fixed gear when the housing is mounted to the frame, to rotate the shutter to open the waste toner discharge port.

9. The apparatus according to claim 8, wherein the shutter comprises a latch to hold the shutter in place when the shutter covers the waste toner discharge port.

10. The apparatus according to claim 9, wherein the waste toner discharge port has a projection to engage the latch.

11. The apparatus according to claim 8, wherein the fixed gear is a rack gear.

12. The apparatus according to claim 8, wherein the pinion gear is integrally formed with the shutter on an outer circumference of the shutter.

13. The apparatus according to claim 8, wherein the pinion gear engages the shutter on a side of the shutter.

14. The apparatus according to claim 8, further comprising a waste toner container formed under the waste toner discharge port to receive the waste toner discharged from the waste toner discharge port.

15. An apparatus for discharging waste toner, comprising:

a housing detachably mounted to a frame and temporarily storing waste toner;

an auger;

an auger supporting member rotatably supporting the auger;

a waste toner discharge port in the auger supporting member, the auger rotating to gather waste toner and discharge the waste toner from the waste toner discharge port;

a shutter to open and cover the waste toner discharge port;

a pinion gear formed on a circumference of the shutter;

a fixed gear attached to the frame;

a latch on a side of the shutter; and a projection on the auger supporting member adjacent to the waste toner discharge port, wherein when the housing is disassembled from the frame, the pinion gear rotates along the fixed gear in a first direction, which rotates the shutter to cover the waste toner discharge port, the latch engaging the projection to hold the shutter in place over the waste toner discharge port, and wherein when the housing is mounted to the frame, the pinion gear rotates along the fixed gear in a direction opposite the first direction, which rotates the shutter and releases the latch from the projection to open the waste toner discharge port.

16. A method of disassembling and assembling an apparatus for discharging waste toner, the apparatus comprising a housing detachably mounted to a frame, an auger supporting member rotatably supporting an auger that rotates to gather waster toner for discharge through a waster toner discharge port, a shutter to open and close the waste toner discharge port, a pinion gear formed on a circumference of the shutter, a fixed gear attached to the frame, a latch on a side of the shutter, and a projection on the auger supporting member adjacent to the waste toner discharge port, the method comprising:

disassembling the housing from the frame by lifting the housing, said lifting the housing comprising rotating the pinion gear along the fixed gear in a first direction and rotating the shutter to cover the waste toner discharge port, engaging the latch with the projection to hold the shutter in place over the waster toner discharge port, and releasing the pinion gear from the fixed gear; and assembling the housing to the frame by engaging the pinion gear with the fixed gear and lowering the housing, said lowering the housing comprising rotating the pinion gear along the fixed gear in a direction opposite the first direction and rotating the shutter to release the latch from the projection and open the waste toner discharge port.

* * * * *

UNITED STATES PATENT AND TRADEMARK OFFICE

CERTIFICATE OF CORRECTION

PATENT NO. : 6,882,821 B2
DATED : April 19, 2005
INVENTOR(S) : Heung-sup Jeong et al.

It is certified that error appears in the above-identified patent and that said Letters Patent is hereby corrected as shown below:

Title page,
Item [75], Inventors, change city for both inventors from “Suwon” to -- Suwon-si --.

Column 8,
Line 22, replace “waster” with -- waste -- (both occurences).
Line 34, replace “waster” with -- waste --.

Signed and Sealed this

Seventeenth Day of January, 2006

JON W. DUDAS
*Director of the United States Patent and Trademark Office*